United States Patent [19]

Reedy et al.

[11] 4,104,888

[45] Aug. 8, 1978

[54] DEFROST CONTROL FOR HEAT PUMPS

[75] Inventors: Wayne R. Reedy, Cazenovia; Fredrick R. Eplett, Liverpool, both of N.Y.

[73] Assignee: Carrier Corporation, Syracuse, N.Y.

[21] Appl. No.: 764,321

[22] Filed: Jan. 31, 1977

[51] Int. Cl.[2] ..... F25D 21/02

[52] U.S. Cl. ..... 62/80; 62/140; 62/154

[58] Field of Search ..... 62/140, 138, 154, 126, 62/80

[56] References Cited

U.S. PATENT DOCUMENTS 3,474,638 10/1969 Dodge ..... 62/154 X

*Primary Examiner*—William E. Wayner

*Attorney, Agent, or Firm*—J. Raymond Curtin; Robert P. Hayter

[57] ABSTRACT

A control system for monitoring frost accumulation on the coil of a heat pump. An operational parameter of the heat pump compressor responsive to frost accumulation, such as compressor current, is compared to a reference level developed during a non-frost condition of the coil to initiate and terminate coil defrosting in response to a predetermined variation between the operational and reference parameter levels.

14 Claims, 2 Drawing Figures

DEFROST CONTROL FOR HEAT PUMPS

BACKGROUND OF THE INVENTION

This invention relates in general to monitoring systems and, in particular, to a monitoring system for controlling the initiation and termination of a defrost cycle for a heat pump coil.

More specifically this invention relates to a system for monitoring an operational parameter of a heat pump which is responsive to the accumulation of frost upon the heat pump coil.

Air conditioners, refrigerators and other heat pumps produce a controlled heat transfer by the evaporation in an evaporator chamber of a liquid refrigerant under pressure conditions which produce the desired evaporation temperatures. The liquid refrigerant removes its latent heat of vaporization from the medium being cooled and in this process is converted into a vapor at the same pressure and temperature. This vapor is then conveyed into a condensor chamber in which the pressure is maintained at a predetermined level to condense the refrigerant at a desired temperature. The quantity of heat removed from the refrigerant in the condensor is the latent heat of condensation plus the quantity of heat which has been added to the liquid refrigerant in the process of conveying the refrigerant from the evaporator pressure level to the condensor pressure level. After condensing, the liquid refrigerant is passed from the condensor through a suitable throttling device back to the evaporator to repeat the cycle.

In a closed cycle system, generally a mechanical compressor or pump is used to transfer the refrigerant vapor from the evaporator (low pressure side) to the condensor pressure (high pressure side). The vaporized refrigerant drawn from the evaporator is compressed and delivered to the condensor wherein it is liquified transferring the latent heat of condensation, and the heat added in transferring the refrigerant vapor from the low side pressure to the high side pressure, to the condensor cooling medium. The liquified refrigerant is then collected in the bottom of the condensor or in a separate receiver and fed back to the evaporator through the throttling device.

Evaporators of many different types are known in the art and all such evaporators are designed with the primary object of affording easy transfer of heat from the medium being cooled to the evaporating refrigerant. In one commonly known type of evaporating system (direct-expansion), refrigerant is introduced into the evaporator through a thermal expansion valve and makes a single pass in thermal contact with the evaporator surface prior to passing into the compressor suction line.

While the evaporator functions to permit the liquid refrigerant to pass from a liquid state into a vapor state extracting the latent heat of vaporization from the surrounding medium, the function of the condensor is the reverse of the evaporator, i.e., to rapidly transfer heat from the condensing refrigerant to the surrounding medium. One of the frequently encountered and well known problems associated with air-source heat pump equipment is that during heating operations the outdoor coil which is functioning as an evaporator, tends to accumulate frost which reduces the efficiency of the system. In order to periodically remove the accumulated frost, various automatic defrosting systems have been devised such as heating the coils or reversing the operation of the system. However, whatever the particular defrosting system employed in the heat pump, it is necessary for optimum system efficiency to determine exactly when the outdoor coil has accumulated sufficient frost to reduce their efficiency.

Different types of frost control systems have been utilized varying from the use of a timer to periodically initiate and terminate defrost systems to sophisticated infrared radiation emitting and sensing means mounted on the fins of the refrigerant-carrying coils such as disclosed in U.S. Pat. No. 3,961,495. Other such defrost detection systems utilize a coincidental signal system in response to the pressure differential of air flow across the heat exchanger caused by frost accumulation blocking the air flow of the heat exchanger such as disclosed in U.S. Pat. No. 3,377,817. Another detection system requires coincidence between two independently operable variables each of which may indicate icing such as air pressure within the shroud of the evaporator and the temperature differential within the evaporator coil as disclosed in U.S. Pat. No. 3,062,019. While these above referred to systems may be satisfactory in certain circumstances for initiating and terminating the operations of a defrosting system, such systems add to the further complexity of the heat pump operation, increase cost, introduce additional system variables and increase potential component failure into the system.

SUMMARY OF THE INVENTION

It is, therefore, an object of this invention to improve monitoring systems for detecting the accumulation of frost on a heat pump coil.

Another object of this invention is to control the initiation and termination of a defrost cycle for a heat pump coil in response to the accumulation of frost on the coil.

A further object of this invention is to monitor the accumulation of frost on a heat pump coil by sensing an operational parameter of the heat pump system which is directly responsive to the accumulation of frost on the coil.

These and other objects are attained in accordance with the present invention wherein there is provided a coil frost monitoring system for initiating and terminating the defrost of the coil in response to the operation of the heat pump compressor.

DESCRIPTION OF THE DRAWINGS

Further objects of the invention, together with additional features contributing thereto and advantages accruing therefrom, will be apparent from the following description of a preferred embodiment of the invention which is shown in the accompanying drawings wherein like reference numerals indicate corresponding parts throughout, wherein.

DESCRIPTION OF A PREFERRED EMBODIMENT

Figure 2:
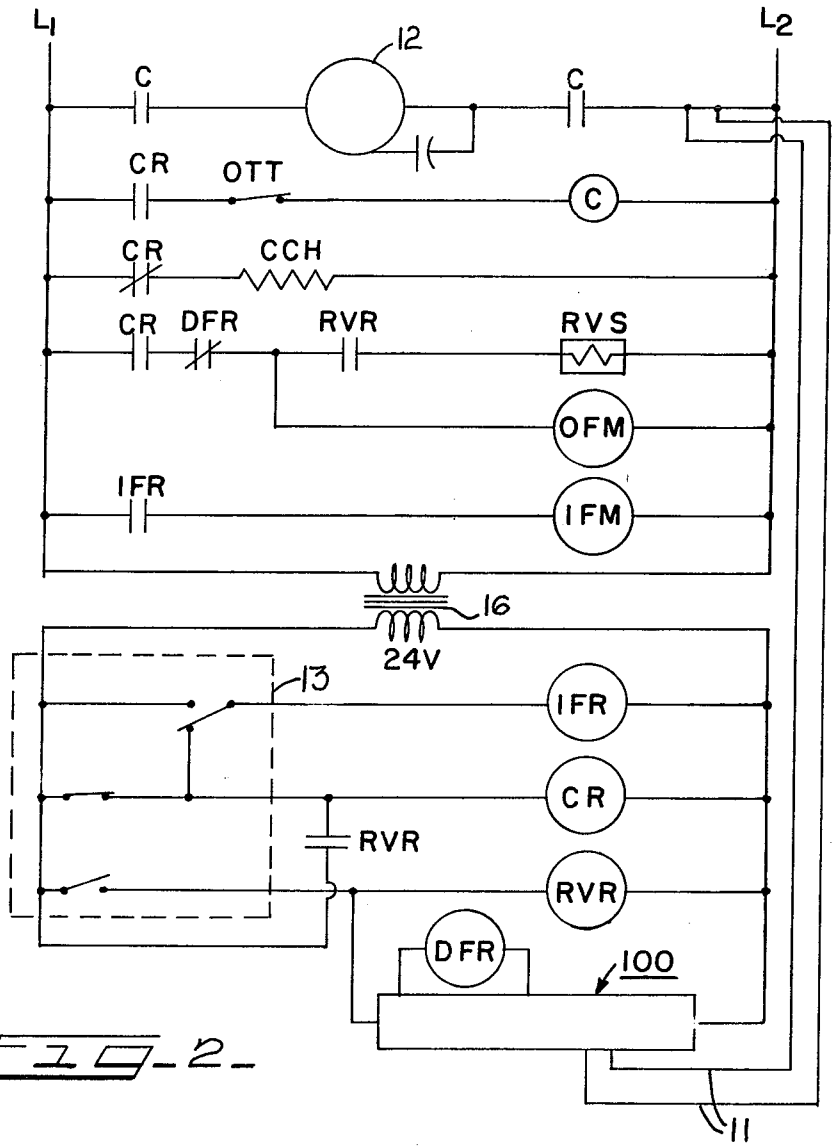
FIG. 2 is a functional block and schematic diagram showing the manner in which the monitoring system is incorporated in the operational circuitry of a typical heat pump.
Figure 1:
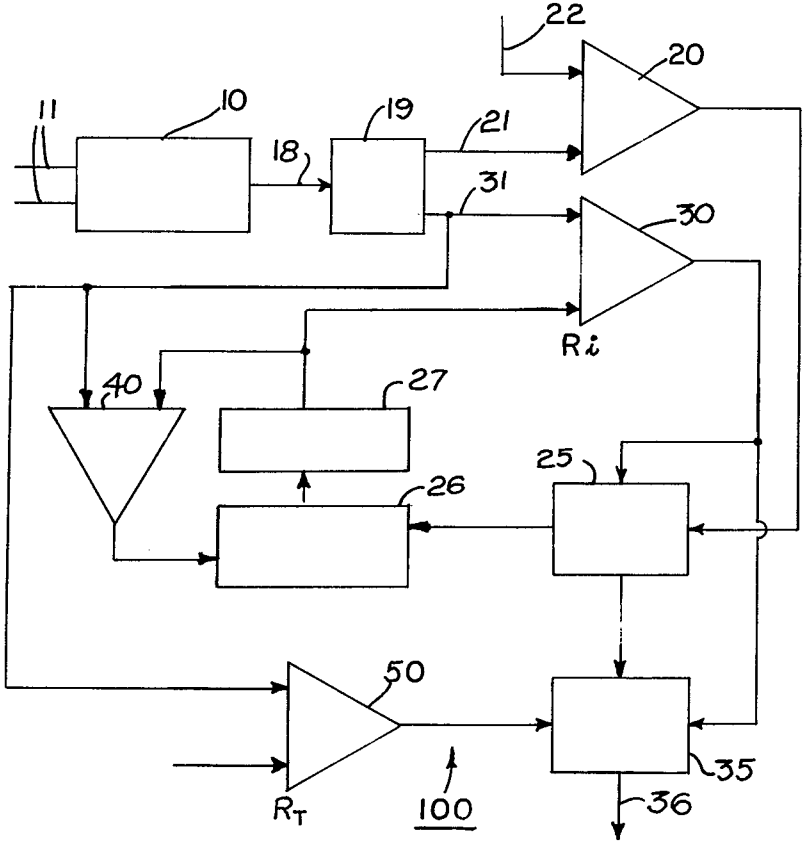
FIG. 1 is a functional block diagram of the monitoring system for initiating and terminating a defrost cycle in response to the operation of a heat pump compressor.

Referring now to both FIG. 1 and FIG. 2, a preferred embodiment of the monitoring system, generally indicated by the reference numeral 100, includes a current transformer 10 having its primary winding 11 (FIG. 2) in the power line to a heat pump compressor 12. Since the amount of current used by the compressor 12 for a given set of environmental variables such as temperature, relative humidity, etc., will decrease as frost accumulates on one of the coils (not shown), the current flow to the compressor 12 will provide a variable operational parameter which is directly responsive to the accumulation of frost on the heat pump coil. By comparing the signal from the primary winding 11 of the current transformer during operation of the compressor motor with a predetermined reference signal established for each operational cycle and, therefore, based upon the same environmental variables when the coil is in a frost-free condition, the frost accumulation on the coil can be monitored. After a predetermined amount of frost has accumulated on the coil, a defrost cycle sequence of operation is initiated in response to the current required by the compressor 12 decreasing to a value less than a predetermined differential from the reference signal. While the preferred embodiment disclosed herein monitors the current to the compressor 12, it is to be understood that other compressor parameters such as compressor voltage differentials could also be utilized.

In FIG. 2 there is illustrated a typical heat pump electrical schematic for controlling operational sequences. For purposes of illustration the heat pump is shown in operation controlled through a thermostat 13. When a suitable power supply is coupled between supply lines $L_1$ and $L_2$, power is supplied to the thermostat 13 through a transformer 16. An indoor fan relay IFR will be actuated closing its contacts to energize an indoor fan motor IFM. A control relay CR is energized closing its normally open contacts to actuate an outdoor fan motor OFM through a set of normally closed contacts of a defrost relay DFR and to actuate a compressor contactor C through a normally closed contact of a over-temperature thermostat OTT. Energizing the compressor contactor C closes its normally open contacts energizing the heat pump compressor 12 which will provide an input signal to the current transformer 10 through leads of the primary winding 11. The remaining components illustrated in FIG. 2, such as the reversing valve relay RVR, the reversing solenoid RVS and the crankcase heater CCH are coupled in a typical manner, but a detailed explanation of their operation is not necessary for an understanding of the invention.

The defrost control monitoring system 100 is shown in FIG. 1 wherein the primary winding 11 of the current transformer 10 is connected in series with the compressor motor and carries the compressor current. The output from the current transformer, an analog signal proportional to compressor motor current, is coupled on line 18 to an amplifier 19 wherein the signal is amplified and coupled to two comparators 20 and 30 through lines 21 and 31, respectively. The output from amplifier 19 on line 31 is also coupled as one input to each of the comparators 40 and 50 for a purpose to be hereinafter described in detail. The comparator 20 is provided with a second input 22 which couples a fixed voltage level reference signal to the comparator. The fixed voltage level reference input defines the minimum current level necessary to determine that the compressor is operating so that the control does not mistake zero current for a low current and try to initiate defrost.

It is desirable to have a reference signal for each cycle of compressor motor operation which establishes a current level responsive to no-frost operation of the heat pump coil at ambient environmental conditions. At the beginning of operation when the compressor 12 is initially turned on, for example, either upon initial installation of the equipment, after a power failure, or upon seasonal start-up, the defrost cycle is initiated. Upon completion of the defrost cycle, in a manner to be hereinafter described in detail, a defrost initiation latch 35 will be reset to allow the system to establish a reference signal which indicates compressor motor current level at a frost-free condition of the coil.

During operation of the compressor 12, a compressor motor current signal is provided on lead 21 at a level proportional to the motor current of the compressor 12 with the condensor coil in a frost-free condition. A signal level on lead 21 greater than the voltage on lead 22 will cause the compressor-on comparator 20 to go from a low state (logic zero) to a high state (logic one) to cause an output from the comparator 20 which is coupled to a delay circuit 25. The delay circuit 25 provides a one-minute time delay before the compressor-on signal from comparator 20 is coupled through the delay circuit 25 to the counter and latch circuit 26. The one-minute time delay is provided to insure that the system has stabilized and that any transient conditions are eliminated from the system. At the end of the one-minute time delay, the compressor-on comparator 20 going from logic zero to logic one enables the counter and latch circuit 26 to begin accepting data through reference signal establishing comparator 40. The comparator 40 receives one of its inputs from the output lead 31 from amplifier 19. The other input to comparator 40 is from the output of a digital to analog converter 27. After the latch 35 has been reset and at the end of the one-minute time delay, the output from the digital to analog convertor is at a level such that the input from the amplifier 19 will cause the output from the comparator 40 to go high to start a sample cycle for a no-frost condition of the coil which will be utilized as a reference input to the defrost initiate comparator 30.

The counter and latch circuit 26 are initially, or have been reset, at zero. Therefore, the output from the digital to analog convertor 27 is also zero. The signal from the amplifier 19 through the compressor-on comparator 20 has been delayed one minute through the delay circuit 25 to eliminate transient conditions of the system from being coupled to the counter and latch 26. After the time delay of one minute, the time delayed signal to the counter and latch 26 permits the counter to accept the input from comparator 40 to start the counter counting up from zero. As the counter 26 continues to count up, the output therefrom coupled to the digital to analog convertor 27 produces an analog signal from the convertor 27 which rises until it reaches the level of the input signal from the amplifier 19. When the output from the digital to analog convertor 27 reaches a level equivalent to the input signal to the comparator 40 from line 31, the comparator goes to a logic zero state stopping the counter 26 at that level to provide a reference signal equal to the power requirement of the compressor during a non-frost condition of the coil for the ambient environmental factors present during that cycle of operation. This value is held in the latch 26 and the digital to analog convertor 27 provides an analog reference signal of this value on the other input to the comparator 30. The system now has a reference signal at a terminal $R_i$ of comparator 30 to be compared with continued operation of the compressor 12 for controlling the initiation of a defrost sequence.

During operation, the current to the motor of the compressor 12 is continually monitored producing the amplified analog signal on the output leads 21 and 31 responsive to the amount of frost on the coil. As frost begins to accumulate on the coil, the current required by the compressor 12 will decrease. At a predetermined level, dependent upon the differential set between the reference signal on input terminal $R_i$ and the signal level on lead 31, the defrost initiation comparator 30 will initiate defrost. When the comparator 30 goes from logic zero to logic one a signal is coupled as an input to the time delay circuit 25 and the defrost initiation latch 35. The presence of a signal to the defrost latch 35 will cause a signal 36 to be generated by the latch 35 to initiate the defrost cycle removing the frost accumulation from the coil. The defrost signal 36 will be present from latch 35 until such time as the latch is reset by an input from the current terminate comparator 50 or a timed failsafe termination signal from the time delay circuit 25. While the preferred embodiment disclosed herein utilizes a compressor driven defrost cycle, if other defrost methods are utilized the current terminate comparator would not be used as the compressor 12 would be off during defrost. However, the time delay circuit 25 could control termination.

When the frost has been removed from the coil, the power or current required by the compressor 12 will increase. The turn off comparator 50 has as one input thereof the signal or output lead 31 of the amplifier 19 which as previously discussed is an input responsive to the current presently being utilized by the compressor 12. A second input is provided on terminal $R_T$ at a level equal to the current level during operation of the compressor 12 when the coil is frost-free. When the frost accumulation has been removed thereby increasing the current required by the compressor 12, the signal to the turn off comparator 50 from line 31 will be equivalent to the reference signal on terminal $R_T$ causing the comparator 50 to go to a high or logic one state resetting the latch 35 and terminating the defrost heating system or sequence. The system is now conditioned for another cycle of operation in the manner previously described.

In addition to the turn off signal provided by the comparator 50, the output from defrost initiation comparator 30, as previously stated, is coupled to the time delay circuit 25 as well as to the defrost initiation latch 35. In this manner the presence of a signal from comparator 30 to initiate the defrost sequence will also initiate a time sequence, for example ten minutes, which will reset the defrost latch 35 at the end of the time delay terminating the defrost system in the event the latch has not been reset through comparator 50.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A control system for monitoring the operation of a vapor compression refrigeration system to detect frost accumulation on a heat exchanger coil comprising;

a compressor operatively connected to the coil for effecting thermal contact between two heat transfer media to effect transfer of heat from one medium to another medium, sensor means operatively connected to said vapor compression refrigeration system for providing an output signal in response to an operational parameter of said vapor compression refrigeration system responsive to the rate of heat transfer;

means coupled to the output signal from the sensor means for generating a reference signal having a reference level dependent upon the output signal from the sensor means in response to an absence of frost on the coil;

comparator means coupled to said output signal from said sensor means and to said reference signal from said means for generating a command signal in response to said output signal varying from the predetermined reference signals; and means coupled to said command signal and operatively connected to said coil for initiating a change in the rate of heat transfer between the two heat transfer media in response to the presence of said command signal.

2. A control system for monitoring the operation of a vapor compression refrigeration system to detect the accumulation of frost on a coil comprising:

a compressor and a heat exchanger coil operatively connected for transferring heat between two heat transfer media;

sensor means operatively connected to said compressor for providing an output signal in response to an operational parameter of the vapor compression refrigeration system, said operational parameter varying in response to frost on the coil;

means coupled to the output signal of the sensor means for generating a reference signal having a reference level dependent upon the output signal from the sensor means in response to an absence of frost on the coil;

comparator means for receiving said output signal and said reference signal and for generating a command signal in response to said output signal varying from the predetermined reference signal; and defrost means operatively connected with said coil and actuable upon receiving said command signal for removing frost from said coil in response to the presence of said command signal.

3. The apparatus of claim 2 further including:

terminating means coupled between said sensor means and said defrost means for receiving said sensor means output signal and a reference signal corresponding to the operation of said compressor in response to the absence of frost on said coil; and said terminating means generating a termination signal coupled to said defrost means upon coincidence of said sensor means output signal with said reference signal for terminating defrosting of said coil.

4. The apparatus of claim 2 further including:

timing means coupled between said sensor means and said defrost means to receive said sensor means output signal for actuating a termination signal coupled to said defrost means upon a predetermined time from receipt of said sensor means output signal to terminate defrosting of said coil.

5. The apparatus of claim 2 wherein said predetermined reference level signal of said means is established by a signal from said sensor means coupled to said comparator means upon initiation of said compressor operation and upon the completion of each defrost cycle.

6. The apparatus of claim 4 further including time delay means coupled between said comparator means and said sensor means for receiving said sensor means output signal upon initiation of said compressor operation and delaying the coupling thereof to said comparator means for a predetermined time delay to stabilize said signal.

7. The apparatus of claim 2 wherein said sensor means comprises a current transformer having a winding operatively connected to a current supply for said compressor providing an output signal in response to the current thereto.

8. A method of detecting the accumulation of frost on the coil of a vapor compression refrigeration system by monitoring the operation of a compressor motor comprising the steps of:

monitoring an operational parameter of the compressor motor responsive to the rate of heat transfer of a coil operatively connected thereto and producing therefrom a continuous electrical output signal indicating the variation in the operational parameter during cyclic operation of the compressor motor;

generating from said monitored parameter an electrical reference signal indicating operation of the compressor motor during frost free operation of the coil;

comparing said electrical output signal produced during cyclic operation with said reference signal and producing a command signal in response to a predetermined variation between said output and reference signals; and coupling said command signal to defrost means actuable upon receipt of said command signal to effect defrosting of said coil.

9. The method of claim 8 wherein said electrical reference signal generated from said monitored parameter is established following each defrost cycle.

10. The method of claim 8 wherein the step of monitoring an operational parameter of a compressor motor responsive to the rate of heat transfer of a coil operatively connected thereto comprises sensing the current flow to the compressor.

11. The method of claim 8 further including establishing from the monitored parameter an electrical reference signal indicating operation of the compressor motor during frost free operation of the coil.

12. The method of claim 8 further including the step of terminating said command signal in response to comparison between said output signal and a separate reference signal.

13. The method of claim 8 further including the step of coincidentally upon producing said command signal producing a time-delayed terminating signal for coupling to said defrost means to effect termination thereof upon receipt of said time-delayed terminating signal.

14. The method of claim 8 further including the step of time delaying the producing of said continuous electrical output signal and said electrical reference signal to eliminate spurious, transient electrical signals not responsive to the rate of heat transfer of the coil.

* * * * *